US007740368B2

(12) United States Patent
Chiang

(10) Patent No.: US 7,740,368 B2
(45) Date of Patent: Jun. 22, 2010

(54) CAP WITH A LIGHT EMITTING DIODE (LED) FOR ILLUMINATING A BEVERAGE CONTAINER

(76) Inventor: Ming Chiang, 206 Woodbury Rd., Woodbury, NY (US) 11797

( * ) Notice: Subject to any disclaimer, the term of this patent is extended or adjusted under 35 U.S.C. 154(b) by 211 days.

(21) Appl. No.: 11/971,033

(22) Filed: Jan. 8, 2008

(65) Prior Publication Data

US 2009/0175029 A1 Jul. 9, 2009

(51) Int. Cl.
*F21V 33/00* (2006.01)

(52) U.S. Cl. ..... 362/101; 362/154; 362/800

(58) Field of Classification Search ..... 362/101, 362/154, 155, 800; 222/113; 215/230
See application file for complete search history.

(56) References Cited

U.S. PATENT DOCUMENTS 3,868,671 A * 2/1975 Maguire et al. ..... 340/323 R
5,800,041 A * 9/1998 Poggi ..... 362/101
6,086,216 A * 7/2000 Goldfarb ..... 362/101
6,179,436 B1 * 1/2001 Gitkind ..... 362/154

* cited by examiner

*Primary Examiner*—Gunyoung T Lee
(74) *Attorney, Agent, or Firm*—F. Chau & Associates, LLC

(57) ABSTRACT

A cap for illuminating a beverage container includes a lens, a light emitting diode (LED), a battery, a control circuit, a control button, and a transparent lower section. The LED is mounted between a top cover of the cap and the lens. The LED is positioned to project light downward towards the lens. The control circuit is powered by the battery to drive the LED when activated. The control button is mounted in the top cover of the cap to activate the control circuit. The lower section is mounted to a base of the lens. The lower section is configured to be removably attached to the beverage container.

17 Claims, 5 Drawing Sheets

CAP WITH A LIGHT EMITTING DIODE (LED) FOR ILLUMINATING A BEVERAGE CONTAINER

BACKGROUND OF THE INVENTION

1. Technical Field

The present disclosure relates to a lighted cap, and more particularly to a cap with an LED that is used to illuminate a beverage container.

2. Discussion of Related Art

A beverage container can be illuminated for various purposes. For example, an illuminated beverage container can be used to attract a prospective buyer to a product or merely as a light source.

Typically, beverage containers are illuminated by a lamp and corresponding circuitry mounted in a base section of the container below a beverage containing section of the container. The lamp faces upward to illuminate the beverage containing section with light from the base section.

In one illuminated beverage container, the lamp is lit by contacts of the circuitry that extend from the base section into the beverage containing section. A domed wall that transmits light is provided between the base section and the beverage containing section. The circuitry uses a battery to power the lamp. The lamp is then lit when the circuitry is activated by liquid in the container electrically connecting the contacts. In a similar illuminated beverage container, the lamp is an LED and a central portion of the base of the beverage containing section is shaped as a lens to focus the light of the LED.

However, the above illuminated beverage containers are not disposable. Accordingly, the corresponding base sections are not designed to be easily removed.

Spring water, juices, and soft drinks are typically sold in disposable plastic containers. It is neither physically practical nor cost effective to affix the base sections of the above devices to these containers.

Thus, there exists a need for a cap with an LED that can be removably affixed to a beverage container.

SUMMARY OF THE INVENTION

An exemplary embodiment of the present invention includes a cap for illuminating a beverage container. The cap includes a lens, a light emitting diode (LED), a battery, a control circuit, a control button, and a transparent lower section. The LED is mounted between a top section of the cap and the lens. The LED is positioned to project light downward towards the lens. The control circuit is powered by the battery to drive the LED when activated. The control button is mounted in the top section of the cap to activate the control circuit. The lower section is mounted to a base of the lens. The lower section is configured to be removably affixed to the beverage container.

The lower section may includes raised tracks to screw the cap to the neck of the beverage container. The control button may include a flexible membrane. The control circuit may be configured to periodically toggle between lighting and un-lighting the LED. The period of lighting the LED may differ from the period of un-lighting the LED. The control circuit may be configured to periodically toggle between applying a first and second current to illuminate the LED.

An exemplary embodiment of the present invention includes a cap for illuminating a beverage container. The cap includes a first section housing a control button, a control circuit, a second section housing a battery, a light emitting diode mounted to the base of the second section, and a third section comprising a lens. The third section is mounted to the bottom of the first section. The second section is mounted in the third section such that the LED is positioned to project light towards the lens. The control circuit is powered by the battery to drive the LED when activated by the control button.

The cap may include an outer cylinder and an inner cylinder that is transparent. The lens may be mounted to the base of the inner cylinder. The second section may be mounted in the inner cylinder. The inner surface of the outer cylinder may include raised tracks to screw the cap to the neck of the beverage container. The outer surface of the outer cylinder may include ridges for gripping the cap. The control circuit may be configured to periodically toggle between lighting and un-lighting the LED. The period of lighting the LED may differ from the period of un-lighting the LED. The control circuit may be configured to periodically toggle between applying a first and second current to illuminate the LED. The base of the second section may include a reflective material.

An exemplary embodiment of the present invention includes an apparatus to be fitted into a cap for a beverage container that has a flexible top surface. The apparatus includes a button, a control circuit, a battery, an LED, and a lens. The button is mounted to the bottom of the flexible top surface. The control circuit is mounted to a contact of the button. The control circuit is powered by the battery. The battery is mounted to the control circuit. The LED is mounted to a base of the control circuit. The control circuit drives the LED when activated by the button. The lens is mounted to the bottom of the top surface of the cap. The lens encapsulates the button, LED, battery, and control circuit. The LED is mounted to project light downward towards the lens.

The lens of the apparatus may include a rigid and waterproof material. The control circuit of the apparatus may be configured to periodically toggle between lighting and un-lighting the LED. The control circuit of the apparatus may be configured to periodically toggle between applying a first and second current to illuminate the LED. The base of the control circuit may include a reflective material.

BRIEF DESCRIPTION OF THE DRAWINGS

Exemplary embodiments of the invention can be understood in more detail from the following descriptions taken in conjunction with the accompanying drawings in which.

DETAILED DESCRIPTION OF THE EXEMPLARY EMBODIMENTS

Exemplary embodiments of the present invention will be described below in more detail with reference to the accompanying drawings. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
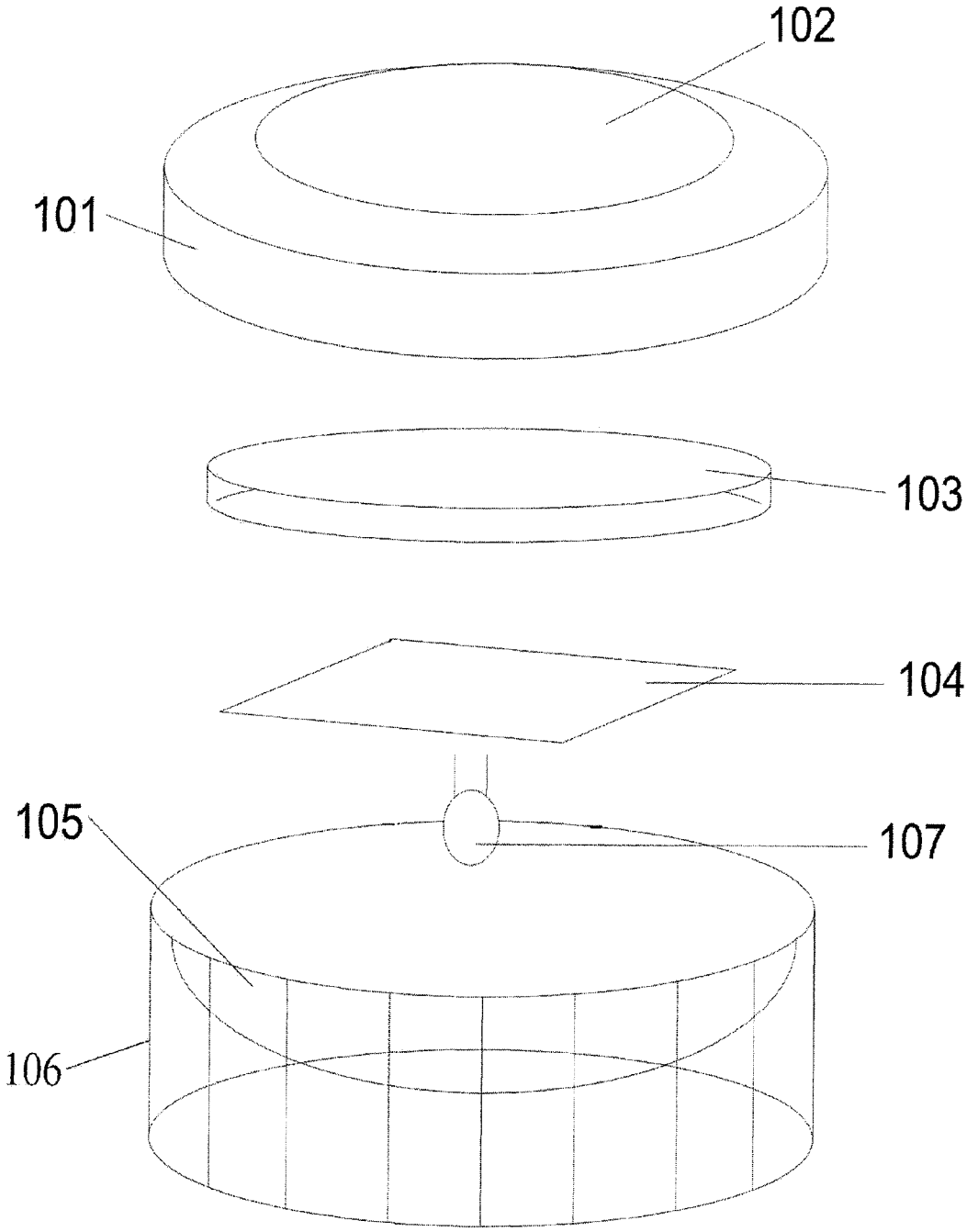
FIG. 1 illustrates elements of a cap for illuminating a beverage container according an exemplary embodiment of the present invention.
Figure 5:
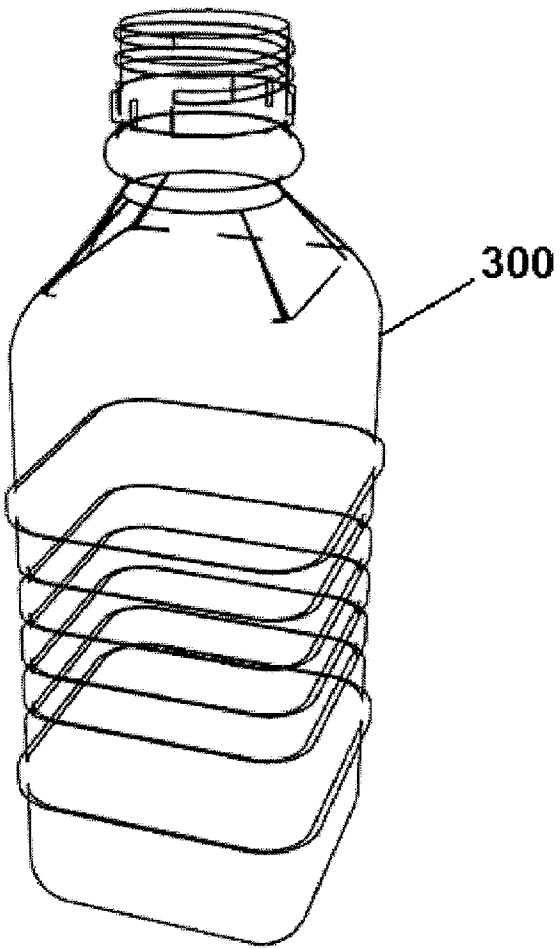
FIG. 5 illustrates an exemplary beverage container in which a cap according to an exemplary embodiment of the present invention may be affixed.

FIG. 1 illustrates elements of a cap according to an exemplary embodiment of the present invention. When the cap is affixed to a beverage container (e.g., a bottle of spring water), the cap projects light downward into the corresponding container. The cap is preferably made of waterproof materials and configured to be removably affixed to the neck of the corresponding container. (e.g., see container 300 of FIG. 5). The cap includes a top cover 101, a battery 103, a control circuit 104, an LED 107, and a lower section 106.

The top cover 101 includes a control button 102 that is mounted in a top opening of the top cover 101. The control button 102 may be made of a flexible membrane, such as plastic or rubber. The control button 102 includes a contact (not shown) that can be used to activate or deactivate the control circuit 104 when the control button 102 is depressed.

The control circuit 104 is powered by the battery 103 to light the LED 107 when activated by the control button 102. When the control circuit 104 is deactivated, the LED 107 is not lit. For example, each press of the control button 102 can toggle the control circuit 104 between active and inactive states. The control circuit 104 can be configured to constantly light the LED 107 when in the active state.

In an alternate embodiment of the present invention, the control circuit 104 can be configured to periodically light and un-light the LED 107 when in the active state. The control circuit 104 may be configured to vary the periods of lighting and un-lighting the LED 107. In this way, the control circuit 104 can be configured to generate various blinking light patterns.

In an alternate embodiment of the present invention, the control circuit 104 can be configured to periodically change the color or intensity of the LED 107. For example, the control circuit 104 can be configured to periodically drive the LED 107 with a varying amounts of current. In this way, the control circuit can be configured to generate various colored blinking light patterns.

The lower section 106 includes a lens 105 to focus the light of the LED 107 downward towards the base of an affixed beverage container. The base of the lower section 106 is covered to prevent liquid of the beverage from leaking into the control circuit 104. The lower section 106 and lens 105 may be formed together as a single contiguous piece. When the container includes a beverage, the light diffuses throughout the beverage, thereby illuminating the container. While the types of beverages can vary considerably, the light is typically brightest when the beverage has a clear color, such as in water or seltzer.

The lens 105 is mounted in a top opening of the lower section 106. The lens 105 is configured to be of a sufficient depth to receive and fit the LED 107. The LED 107 may be positioned at substantially the center of the lens 105. The lens 105 may be made of a rigid and waterproof material, such as plastic.

The lower section 106 includes a bottom opening that is of sufficient diameter to receive and affix the neck of a beverage container. The interior of the lower section 106 may include raised tracks 220 so that the cap can be screwed onto the neck of a container (e.g., see container 300 of FIG. 5). The exterior of the lower section may include ridges (e.g., see ridges 215 of FIG. 4) so that the cap can be more easily gripped when twisted.

Figure 2:
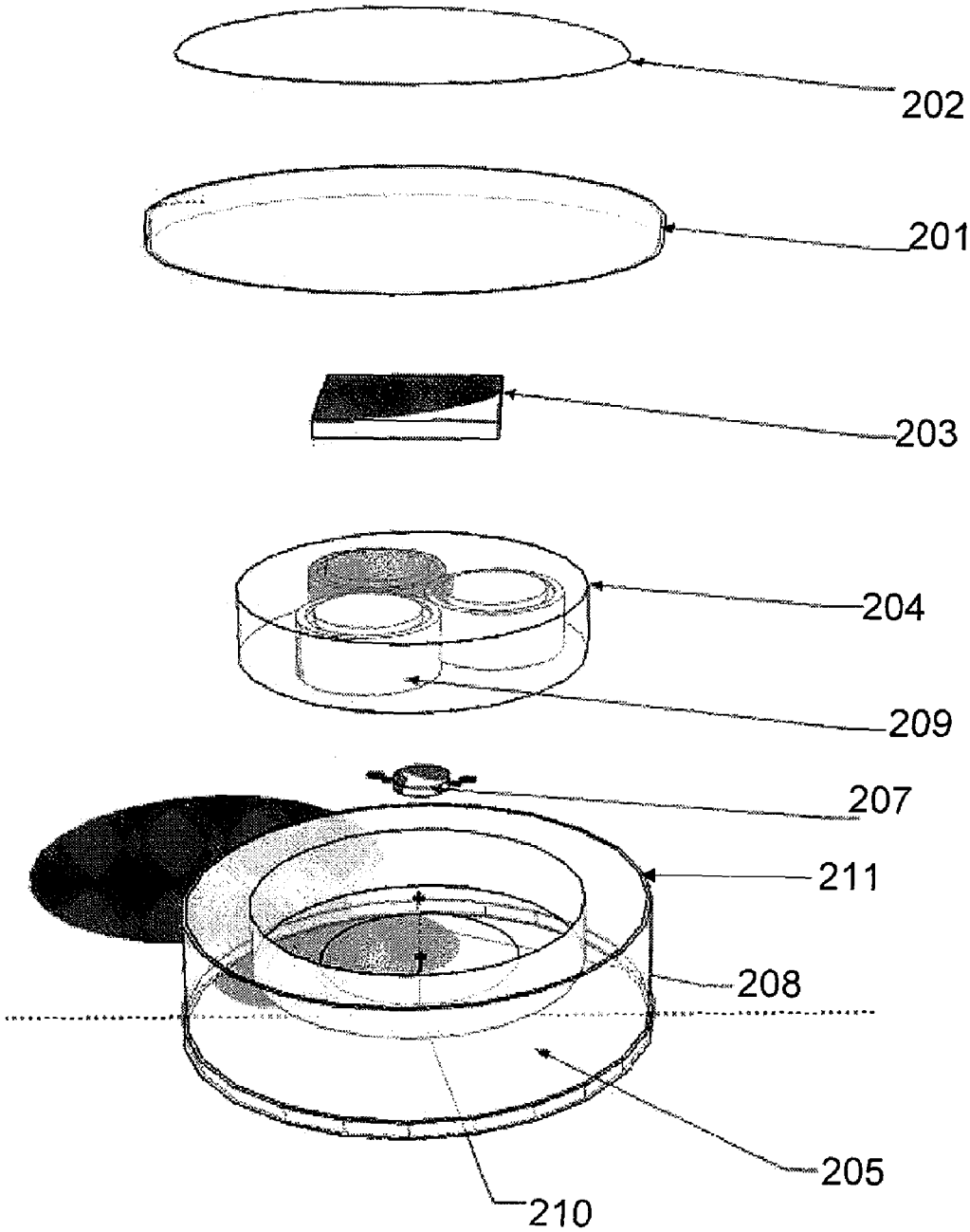
FIG. 2 illustrates elements of a cap for illuminating a beverage container according to an exemplary embodiment of the present invention.
Figure 3:
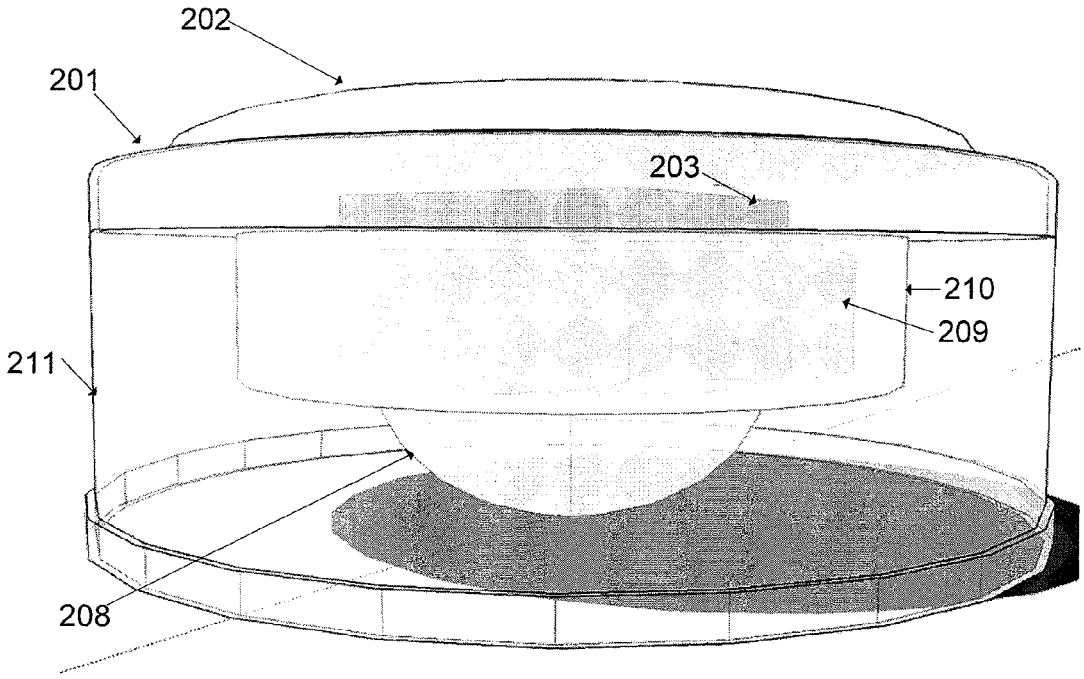
FIG. 3 illustrates a side view of the combined elements of FIG. 2.
Figure 4:
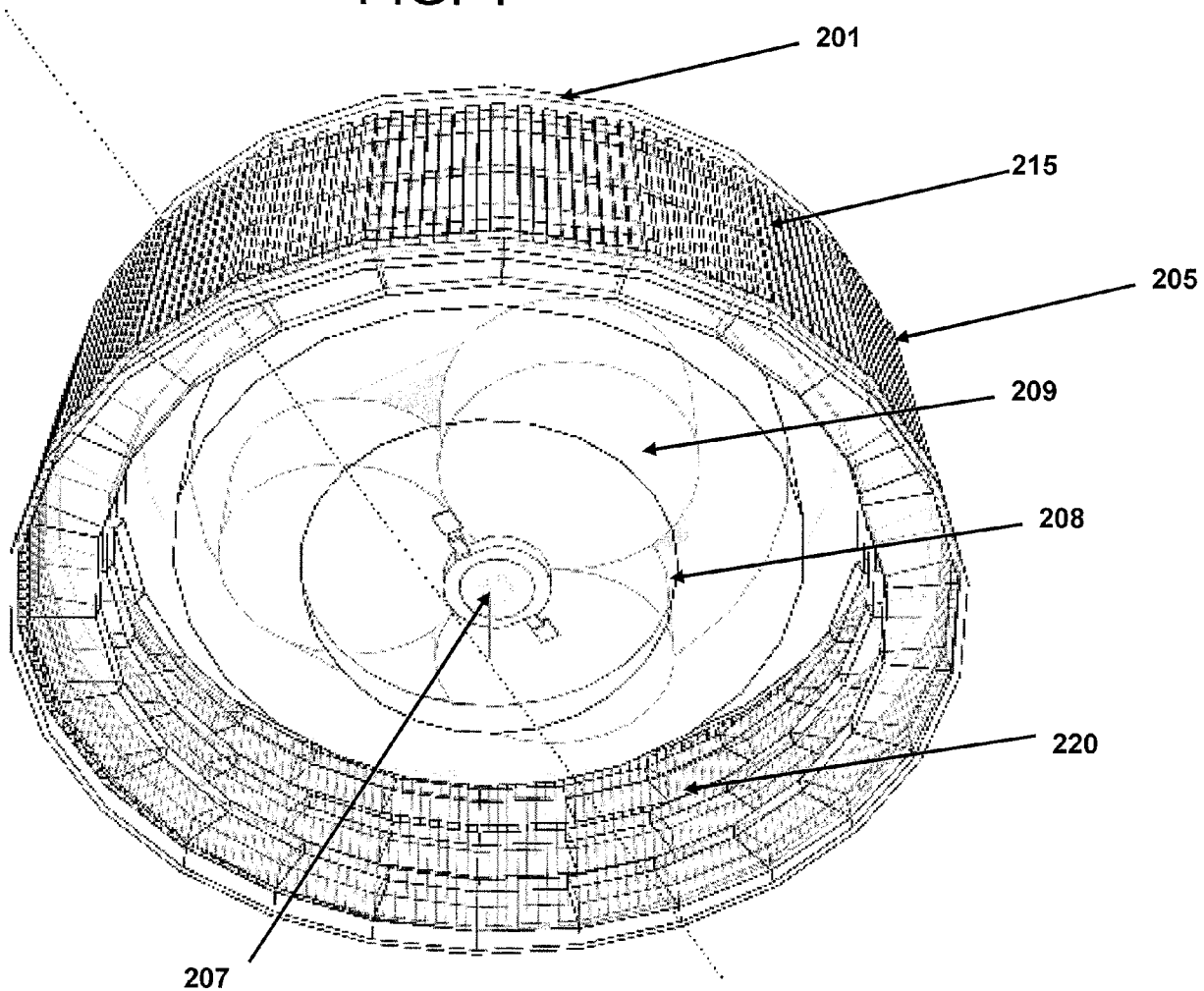
FIG. 4 illustrates a bottom view of the combined elements of FIG. 2.

FIG. 2 illustrates elements of a cap according to an exemplary embodiment of the present invention, FIG. 3 illustrates a side view of the combined elements of FIG. 2, and FIG. 4 illustrates a bottom view of the combined elements of FIG. 2.

Referring to FIGS. 2-4, the cap includes a top cover 201, a control button 202, a control circuit 203, a battery housing 204, an LED 207, and a lower section 205. The cap is configured to project light downward into an attached container. The cap is preferably made of waterproof materials and configured to be removably affixed to the neck of a container.

The control button 202 is mounted in a top opening of the top cover 201. When the control button 202 is depressed, a contact (not shown) of the control button 202 can be used to activate or deactivate the control circuit 203. The control button 202 may be made of a flexible membrane, such as plastic or rubber. The top cover 201 may be made of plastic. The top cover 201 may have a diameter, which can range between about 24 mm to about 35 mm. The height of the top cover 201 may range from 2 mm to about 8 mm.

The battery housing 204 includes one or more batteries 209. The control circuit 203 may be electrically connected to a battery 209 through an opening in the battery housing 204. The LED 207 may be electrically connected to the control circuit 204 through an opening in the battery housing 204. The LED 207 is mounted to the base of the battery housing 204. The base of the battery housing 204 may be made of a reflective material, such as aluminum or tin. The battery housing 204 may be made of plastic. A battery 209 may be alkaline and/or lithium based and range from about 1 to about 3 volts.

The lower section 205 includes a lens 208, an inner cylinder 210 and an outer cylinder 211. The lens 208 focuses the light of the LED 207 downward to the base of an attached beverage container. The inner cylinder 210 is transparent. The base of the inner cylinder 210 is covered to prevent liquid of the beverage from leaking into control circuit 203. The lens 208 and lower section 205 may be formed as a single contiguous piece. The diameter of the inner cylinder 210 and outer cylinder 211 are configured such that the distance between the two is sufficient to receive the neck of a beverage container.

The inner cylinder 210 and outer cylinder 211 may be made of plastic. The outer cylinder 211 may have a diameter that is substantially the same as the top cover 201. The height of the outer cylinder 211 may range from about 8 mm to about 15 mm. The outer cylinder 211 and top cover 201 may be opaque or transparent. An inner surface of the outer cylinder 211 may have raised tracks to enable the cap to be screwed onto the neck of a beverage container. The outer surface of the outer cylinder 211 may have ridges to facilitate the twisting of the cap.

The lens 208 may be mounted to a bottom opening of the inner cylinder 210. The battery housing 204 with the attached LED 207 is configured to fit into a top opening of the inner cylinder 210. The depth of the lens 208 is configured to be deep enough to receive the LED 207. The LED 207 may be mounted so that it is centered within the lens 208. The LED 207 may be positioned and/or angled to projects its light downward towards the center of the lens 208. The lens 208 may be made of a rigid and waterproof material, such as plastic. The depth of the lens 208 may range from about 3 mm to about 7 mm.

Since the battery housing 204 is configured to fit within the inner cylinder 210, the diameter of the battery housing 204 is slightly less than the diameter of the inner cylinder 210. The battery housing 204 may have a height ranging from about 2.5 mm to about 7.5 mm.

The control circuit 203 is powered by a battery 209 and controls the lighting of the LED 207. The control circuit 203 can be configured to constantly or periodically light the LED 207 when activated by the control button 202. For example, the control circuit 203 may be configured such that the LED 207 is lit for a first period of time and unlit for a second period of time, where each of the first and second periods may either be the same or vary from one another. In this way, the control circuit 203 can be configured to generate an assortment of blinking light patterns. The control circuit 203 may also be configured to drive the LED 207 using different amounts of current to vary the color and/or intensity of light generated by the LED 107. In this way, the control circuit 203 can be configured to generate an assortment of colored blinking light patterns.

While the above provided dimensions may be used to implement an embodiment of the present invention, the present invention is not limited these dimensions. For example, since the cap may be affixed to the necks of beverage containers having various dimensions, the above dimensions can be modified accordingly.

An alternate embodiment of the present invention includes an apparatus that includes a subset of the elements illustrated in FIGS. 2-4. The apparatus is fitted into a cap of a container that has a flexible top surface. Preferably, the apparatus is fitted into an inner cylinder of the cap so that the cap may be affixed to its intended container without interference. The apparatus includes the control button 202 which is mounted to the bottom of the top surface of the cap, the LED 207, one or more batteries 109, the control circuit 203, and a lens.

The LED 207 and battery 109 are electrically connected and mounted to the control circuit 203. The LED 207 is mounted to a base of the control circuit 203 to projects its light downward. The base of the control circuit 203 may be made of a reflective material. The control circuit 203 is mounted to a contact of the control button 202.

The lens is similar to the lenses of FIGS. 1-4, except that it is configured to be large enough to encapsulate the control button 202, control circuit 203, battery 209, and LED 207. Further, the lens is sealed to the bottom of the top surface of the cap. Since the cap that the apparatus is fitted into already has a flexible top surface, depressing the surface of the cap depresses the control button 202 to activate or deactivate the control circuit 203 as in the above embodiments.

Although illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A cap for a beverage container, the cap comprising:

a cylinder comprising a flexible material disposed in a top portion of the cylinder;

a battery;

a light emitting diode (LED);

a control circuit activated by contact with the flexible material to drive the LED, the control circuit powered by the battery, the battery mounted to the control circuit and the LED mounted to the base of the control circuit;

a lens mounted to the bottom of the top portion of the cylinder and encapsulating the LED, battery, and the control circuit, wherein the LED is mounted to project light downward towards the lens.

2. The cap of claim 1, wherein the diameter of the cap ranges from about 24 mm to about 34 mm.

3. The cap of claim 1, wherein the lens comprises a rigid and waterproof material.

4. The cap of claim 1, wherein the control circuit includes circuitry to periodically toggle between lighting and un-lighting the LED.

5. The cap of claim 1, wherein the control circuit includes circuitry to periodically toggle between applying a first and second current to illuminate the LED.

6. The cap of claim 1, wherein the base of the control circuit comprises a reflective material.

7. A cap for illuminating a beverage container, the cap comprising:

a first cylinder having a top surface comprising a flexible membrane;

a lens;

a light emitting diode (LED) mounted between the top surface of the first cylinder and the lens, wherein the LED is positioned to project light downward towards the lens;

a battery;

a control circuit powered by the battery to drive the LED when activated by contact with the top surface of the first cylinder; and a transparent second cylinder mounted to the top surface of the first cylinder around the lens, the second cylinder configured to be removably attached to the beverage container.

8. The cap of claim 7, wherein the diameter of first and second cylinders ranges from about 24 mm to about 35 mm.

9. The cap of claim 7, wherein the control circuit includes circuitry to periodically toggle between lighting and un-lighting the LED.

10. The cap of claim 7, wherein the control circuit includes circuitry to periodically toggle between applying a first and second current to illuminate the LED.

11. A cap for illuminating a beverage container, the cap comprising:

a first section housing a control button;

a control circuit;

a second section housing a battery;

a light emitting diode mounted to the base of the second section;

a third section comprising a lens, the third section mounted to the bottom of the first section, wherein the third section comprises an outer cylinder and an inner cylinder that is transparent, and the lens is mounted to the base of the inner cylinder, wherein the second section is mounted in the inner cylinder of the third section such that the LED is positioned to project light downward towards the lens, and wherein the control circuit is powered by the battery to drive the LED when activated by the control button.

12. The cap of claim 11, wherein the diameter of the first and third sections ranges from about 24 mm to about 35 mm.

13. The cap of claim 11, wherein the inner surface of the outer cylinder comprises raised tracks to screw the cap to the neck of the beverage container.

14. The cap of claim 11, wherein the outer surface of the outer cylinder comprises ridges for gripping the cap.

15. The cap of claim 11, wherein the control circuit includes circuitry to periodically toggle between lighting and un-lighting the LED.

16. The cap of claim 11, wherein the control circuit includes circuitry to periodically toggle between applying a first and second current to illuminate the LED.

17. The cap of claim 11, wherein the base of the second section comprises a reflective material.

* * * * *